US010767381B1

(12) United States Patent
Huffer

(10) Patent No.: US 10,767,381 B1
(45) Date of Patent: Sep. 8, 2020

(54) POOL VACUUM GASKET METHOD AND APPARATUS

(71) Applicant: Lisa Huffer, Circleville, OH (US)

(72) Inventor: Lisa Huffer, Circleville, OH (US)

( * ) Notice: Subject to any disclaimer, the term of this patent is extended or adjusted under 35 U.S.C. 154(b) by 0 days.

(21) Appl. No.: 16/430,918

(22) Filed: Jun. 4, 2019

(51) Int. Cl.
*E04H 4/16* (2006.01)
*E04H 4/12* (2006.01)

(52) U.S. Cl.
CPC ..... *E04H 4/1645* (2013.01); *E04H 4/1272* (2013.01)

(58) Field of Classification Search
CPC ..... E04H 4/1645; E04H 4/1272
USPC ..... 210/167.1, 167.16, 167.17, 416.1, 416.2; 15/1.7
See application file for complete search history.

(56) References Cited

U.S. PATENT DOCUMENTS 3,306,448 A * 2/1967 Baker ..... E04H 4/1272 210/121
3,567,020 A * 3/1971 Whitaker ..... E04H 4/1272 210/94
3,640,310 A * 2/1972 Erlich ..... F16K 11/074 137/625.46
4,737,279 A * 4/1988 Lewis ..... E04H 4/1272 134/167 R
4,776,953 A * 10/1988 Frentzel ..... E04H 4/1272 134/167 R
5,238,585 A * 8/1993 Reed, Sr. ..... B01D 29/27 210/805
6,393,628 B1 * 5/2002 Kellogg ..... F16K 1/20 4/490

* cited by examiner

*Primary Examiner* — Fred Prince
(74) *Attorney, Agent, or Firm* — Jason H. Foster; Kremblas & Foster

(57) ABSTRACT

A pool vacuum method and apparatus that uses a skimmer with an aperture that allows pool water to communicate with a chamber in the skimmer. An upwardly-facing shoulder is formed at the base of an upper sidewall and the top of a lower sidewall and a rigid vacuum plate, which has a conduit to which a hose and vacuum head may be attached, is placed adjacent the shoulder. A neoprene gasket is attached to the vacuum plate and is interposed between the shoulder and the vacuum plate. The gasket has a lip that extends radially outwardly of the vacuum plate to form a secondary seal by expanding outwardly against the upper sidewall. Upon operating a pump, the suction causes the vacuum plate and gasket to seal to prevent or greatly inhibit water from passing the vacuum plate and gasket other than through the conduit.

7 Claims, 4 Drawing Sheets

POOL VACUUM GASKET METHOD AND APPARATUS

CROSS-REFERENCES TO RELATED APPLICATIONS (Not Applicable)

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

The invention relates generally to vacuum equipment, and more particularly to equipment used to vacuum particulate from the sides and floor of a pool.

Pools require cleaning in order to remove particulate. Particulate removal may be active or passive. Active cleaning involves a human user physically acting to remove particulate. In passive cleaning, pools equipped with pumps circulate water through filters without the users' direct involvement. Such pumps commonly remove water through a drain in or adjacent to the pool, and some drains are in skimmers that receive water from the top surface of the pool that commonly contains floating particles. Pool vacuuming is a common form of active cleaning, and typically includes a wide head (mounted to a rigid pole that is used by a person to guide the head) that is connected to one end of a hose. The opposite end of the hose is in communication with a pump and filter combination, such as by connecting the hose opposite the head to the pool's filtration system. When the pump is activated, water and debris are drawn into the hose through the head, passed through a filter and then returned to the pool through the pool's filtration system outlet. The process of the pump passing the water through the filter removes the debris from the water, as is well known in the technology.

Some pool owners have a passive pool cleaning pump and a separate active pool cleaning pump. However, this leaves two systems to purchase and maintain. It makes little sense for most people to go to the expense of having two such systems when they are essentially duplicates in the most relevant component. Some have attempted to use the passive pool pump and filter system as an active system by extending a hose and a plate fitted over the aperture that is open to the pool. These are so lacking in suction that they are not a suitable replacement for a dedicated, active system.

BRIEF SUMMARY OF THE INVENTION

Disclosed herein is a vacuum plate adapter and a gasket for converting passive pool pump systems into active systems. The gasket seals the vacuum plate to a sidewall and/or shoulder defining an opening in the passive system, thereby permitting use as an active vacuum for cleaning the pool sides and floor.

A skimmer on a side of the pool connects through a hose or other structure to a pump and filter that ordinarily operates at a predetermined flow rate. Some pool systems have variable flow rate pumps, but these are less common. The adapter may be a vacuum plate with a conduit that connects to a hose connector at one end and a vacuum head at the opposite end. The plate attaches to the skimmer at a shoulder and/or sidewall formed in the skimmer.

The gasket is preferably attached to one side of the vacuum plate, and may be attached using adhesive or other fasteners. The gasket extends outwardly beyond the peripheral boundaries of the vacuum plate, which creates a seal against the shoulder and/or sidewall as well as a secondary seal if the first seal is insufficient. The suction permitted by the invention is so superior that it keeps the vacuum plate in place and also vastly improves the suction through the hose and head available through other passive system converters. In an experiment, the vacuum upstream of the pump was measured to be 2.0 inches of mercury (Hg) with the vacuum plate alone. Using the invention, the pressure was measured to be 14 inches of Hg. Thus, one may conclude that the seal of the vacuum plate to the skimmer has been vastly improved by the gasket, which may reduce the time it takes to vacuum a pool by two-thirds compared to without the gasket.

When the vacuum plate is installed in an operable position, the gasket is interposed between the vacuum plate and the skimmer sidewall and/or shoulder. The gasket extends radially outwardly from the vacuum plate's peripheral edges, and has an opening in the middle to let water flowing through the conduit and hose pass through to the pump.

Disclosed herein is a pool vacuum comprising a skimmer mounted to a wall of a pool. The skimmer has a chamber that is in fluid communication with water in the pool through an aperture formed in the pool wall that is aligned with an aperture in the skimmer sidewall. The skimmer has a shoulder disposed between a skimmer floor and the skimmer sidewall aperture. A rigid vacuum plate is disposed in the chamber. The vacuum plate has a conduit that may extend therefrom through the skimmer sidewall aperture and the pool wall aperture into the pool water and terminates in a vacuum head. Alternatively, the conduit, which may be a rigid fitting and a connected hose, may extend out of the skimmer and over the pool wall into the pool.

The vacuum plate has a lower surface facing, and disposed adjacent, the shoulder. A neoprene gasket is attached to the vacuum plate and interposed between the vacuum plate and the shoulder. The gasket has a central hole aligned with the conduit to permit a flow of water through the conduit to pass through the gasket. The gasket has peripheral edges that extend beyond peripheral edges of the vacuum plate, are interposed between the vacuum plate and the skimmer sidewall, and extend above the shoulder. A pump is fluidly connected to the chamber of the skimmer for pumping water through the vacuum head, the conduit, the gasket, and the vacuum plate.

In some embodiments, the gasket is adhered to the vacuum plate. In some embodiments, the gasket's peripheral edges extend from the shoulder upwardly along the skimmer sidewall to form a secondary seal.

Disclosed herein is a method of constructing a pool vacuum. The method comprises the step of providing a skimmer on a wall of a pool. The skimmer has a chamber in fluid communication with pool water through an aperture formed in the pool wall that is aligned with an aperture in the skimmer sidewall. The skimmer has a shoulder disposed between a skimmer floor and the skimmer aperture. The method includes the step of disposing a rigid vacuum plate in the chamber with vacuum plate peripheral edges adjacent the skimmer shoulder. The vacuum plate has a conduit that may be extended from the vacuum plate through the skimmer sidewall aperture and the pool wall aperture into the pool water and terminating in a vacuum head. The method includes the step of attaching a neoprene gasket to the vacuum plate with the gasket interposed between the vacuum plate and the shoulder. The gasket preferably has peripheral edges extending radially outwardly of the vacuum plate peripheral edges to at least between the vacuum plate peripheral edges and the skimmer sidewall. The method comprises the step of pumping pool water through the vacuum head, the conduit, the vacuum plate, a central hole in the gasket aligned with the conduit, and the chamber, whereby the gasket seats against at least one of the shoulder and the skimmer sidewall.

In some embodiments, the attaching step further comprises adhering the gasket to the vacuum plate with the central hole in the gasket spanning at least a diameter of the conduit. In some embodiments, the method further comprises extending the gasket peripheral edges above the top edge of the vacuum plate to form secondary seals in case of a sufficient flow of water past the shoulder.

Disclosed herein is a pool vacuum component comprising a rigid vacuum plate having a centrally located aperture and peripheral edges. The vacuum plate has oppositely-facing first and second substantially planar disk surfaces. A neoprene gasket, which may be annular, has a centrally located aperture and peripheral edges. The gasket has oppositely-facing first and second substantially planar gasket surfaces. An adhesive is interposed between the first gasket surface and the first vacuum plate surface, thereby fixing the gasket to the vacuum plate. The gasket's peripheral edges extend outwardly of the vacuum plate's peripheral edges sufficiently to reach the second disk surface.

In some embodiments, the vacuum plate's peripheral edges are substantially circular and the gasket's peripheral edges are substantially circular.

Figure 1:
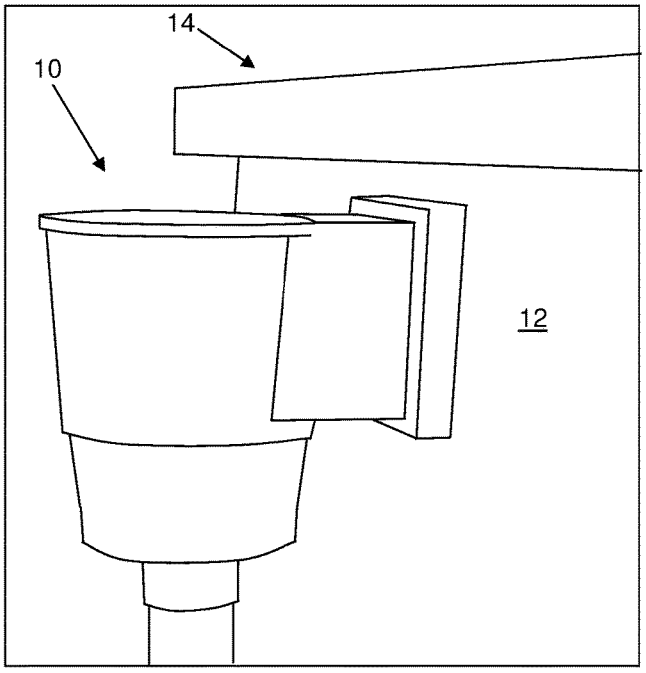
FIG. 1 is a view in perspective illustrating a skimmer attached to a pool sidewall.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Figure 2:
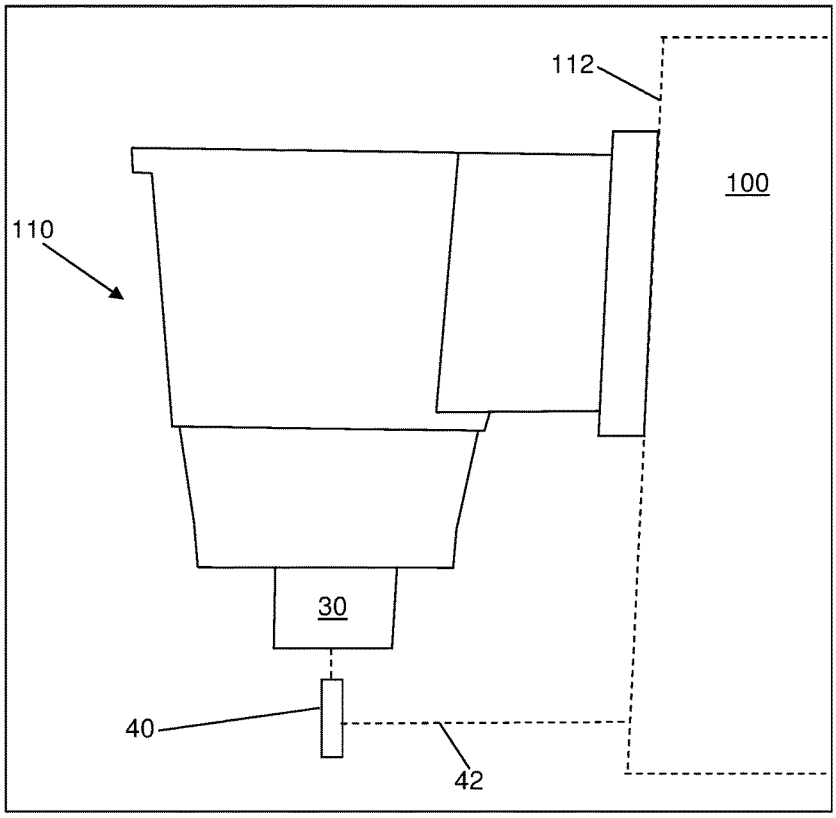
FIG. 2 is a schematic side view illustrating a skimmer attached to a pool sidewall.
Figure 6:
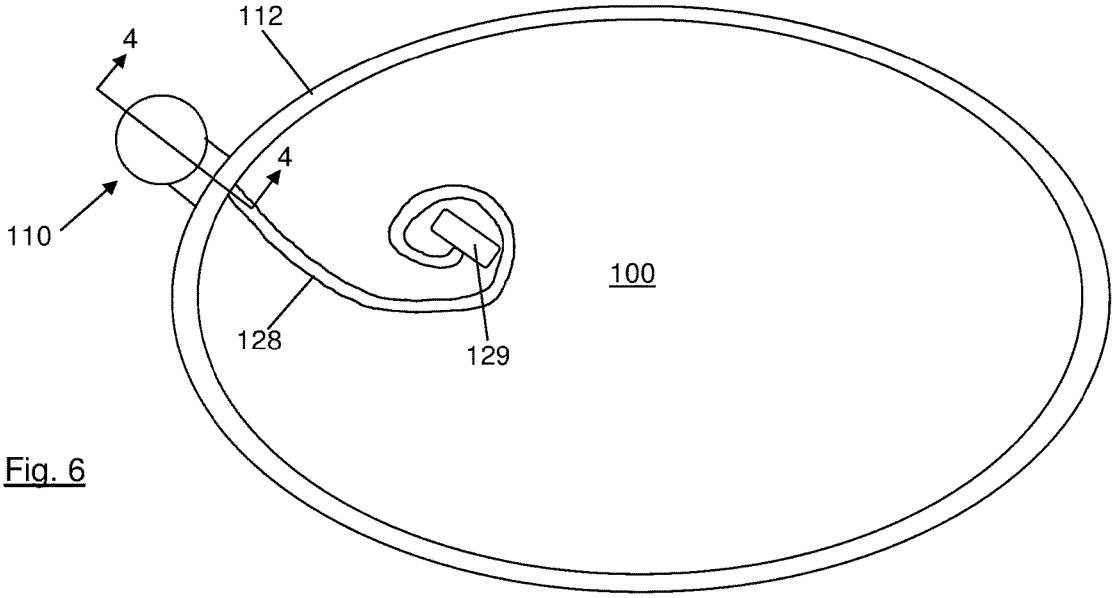
FIG. 6 is a top schematic view illustrating a pool with a skimmer mounted to its sidewall.

A swimming pool skimmer 10 is attached to the sidewall 12 of an above-ground pool 14, as shown in FIG. 1. The illustrated skimmer 10 is for an above-ground pool, which is a pool having sidewalls that are not in substantial contact with the ground around the pool. Typically only the floor of an above-ground pool is in contact with the ground, although the lower edges of the sidewalls may be in ground contact. The invention may be adapted to use with in-ground pools, which have sidewalls that are in substantial contact with, and are supported by, the ground around the pool. This is normally accomplished by the ground being excavated to form a hole, forming or disposing the walls within the hole, and then backfilling the soil or other aggregate against the formed walls of the in-ground pool. In-ground pools typically have exterior surfaces of their sidewalls in contact with, and supported by, the ground around the pool. A person having ordinary skill in the art will understand how to adapt the invention to an in-ground pool application, even though such a pool is not illustrated, and will understand that little to no difference exists in the types of skimmers that are used with above-ground and in-ground pools. FIGS. 2 and 6 show a pool 100 with the skimmer 110 mounted in an operable position on a pool sidewall 112.

Figure 3:
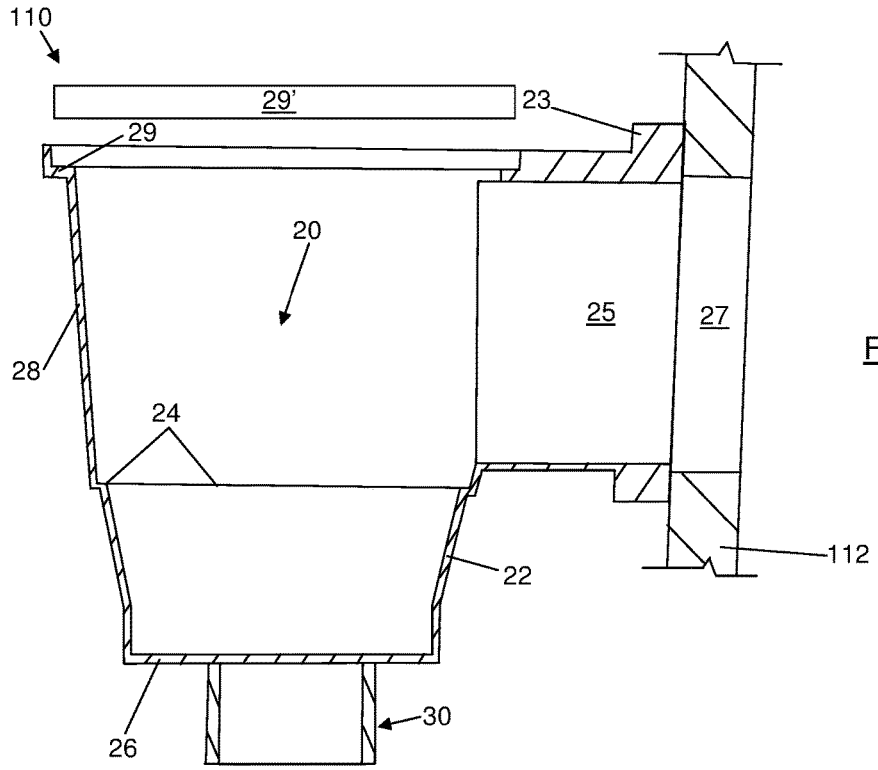
FIG. 3 is a side view in section of the skimmer of FIG. 2 through the lines 4-4 shown in FIG. 6.

As shown in FIGS. 2-3, the skimmer 110 has a chamber 20 defined by an upper sidewall 28 and a lower sidewall 22. The lower sidewall 22 has a shoulder 24 at its upper edge and a floor 26 at its lower edge. Above the shoulder 24, the upper sidewall 28 encircles the shoulder 24 and terminates at the lip 29. The sidewalls 22 and 28 may be circular cylindrical, and may be tapered to form truncated cones. Thus, the chamber 20 is circular in cross section, and the shoulder 24 defines a circular, upwardly-facing surface (in the orientation of FIGS. 2-3). Other contemplated skimmers may define rectangular cylinders or oddly-shaped sidewalls. Thus, it is contemplated that the structures described herein as preferably circular or substantially circular may alternatively be rectangular, triangular or any other shape.

An upwardly facing access aperture may be defined by the lip 29 at the upper sidewall 28, where a lid 29' may be disposed and held in place by gravity. It is common for in-ground pools to have the lip 29 or an equivalent structure disposed just below the surface of a wooden, concrete or other walking surface. Thus, the lid 29' may be placed on the lip 29 to be removed by the hand of a user when access to the chamber 20 is required, such as to remove and clean a conventional skimmer basket (not shown).

A flange 23 may attach to the pool sidewall 112 using conventional fasteners, such as screws, rivets or adhesives. An aperture 25 formed in the sidewall 28 of the skimmer 110 aligns with an aperture 27 in the pool sidewall 112. The aligned apertures 25 and 27 create a void for the passage of water or another liquid in the interior of the pool 100. Thus, the chamber 20 is fluidly connected with the chamber 20 through the apertures 25 and 27 when the level of the water in the pool is above the lower lip of the aperture 25. In conventional use, a skimmer 110 may passively collect particles and other objects floating on the top of the pool water, as such objects flow into the chamber 20.

Water flowing into the chamber 20 may be drawn into a fluid passage, such as the pipe 30 at the bottom of the chamber 20, and transported through a filter to be placed back into the pool. The pipe 30 is connected to the floor 26 at a sealed junction and a pump/filter 40 (shown schematically in FIG. 2) may draw water through the pipe 30 and then push the filtered water through the pipe 42 back into the pool 110 via an outlet that is known in the art. In this manner, pool water is slowly filtered of particulate, oils and other impurities when the skimmer 110 and associated components are used as a passive collection system. The passive system operates the pump/filter 40 at a predetermined speed that pumps water out of the chamber 20.

It is possible to dispose a vacuum plate 124 of shape and diameter similar to, and preferably slightly less than, the diameter of the shoulder 24 adjacent or on the shoulder 24. Although the plate 124 is circular or substantially circular, this is to match the shape of the shoulder 24. Thus, other embodiments contemplate differently-shaped vacuum plates to correspond to differently-shaped shoulders, including rectangular, triangular or oddly-shaped shoulders.

Figure 4:
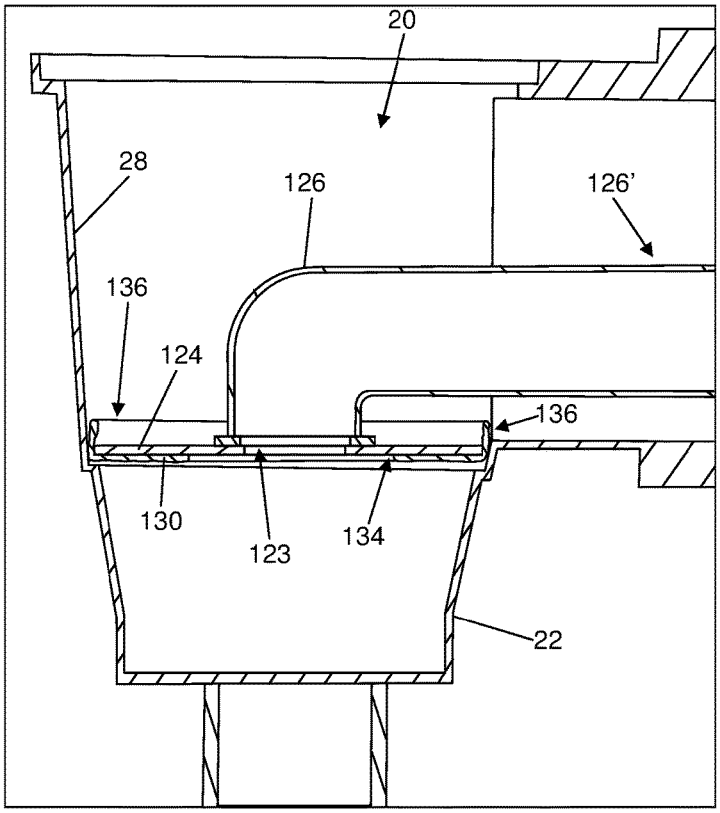
FIG. 4 is the side view in section of FIG. 3 with the addition of a vacuum plate, a gasket and a conduit.

The vacuum plate 124 may be disposed adjacent the shoulder 24 while the pump is operating or after it is turned off. The vacuum plate 124 is shown in FIG. 4 in that position, and the vacuum plate 124 has a conduit 126 attached thereto. The conduit 126 may be a 90-degree PVC elbow sealingly mounted to one side of the vacuum plate 124 with its interior passage aligned with an aperture 123 formed in the vacuum plate 124. Alternatively, the conduit may be a PVC adapter with an axis extending perpendicular to the plane of the vacuum plate 124, which allows a flexible hose 128 or other conduit to extend out of the access aperture formed by the lip 29, over the top of the pool wall and into the pool water.

One end of the flexible hose 128 may be attached to a distal end 126' of the conduit 126. The hose 128 may be a conventional pool vacuum hose known to those skilled in the art. As shown in FIG. 6, at the opposite end of the hose from the distal end 126', a wand or other vacuum fitting head 129 may be attached to permit the suction of water through the hose 128 toward the chamber 20 to be spread over a wider area. The head 129 may be a conventional vacuum head with a flexibly-attached pole that may be placed in contact with the sides or bottom of the pool so that the particles, microbes and/or oils thereon may be removed from a wider area than the hose's diameter by the substantial suction through the hose 128, as is known in the technology for use with other active pool vacuum systems. The user guides the head 129 using the pole while the hose 128 directs suction through the head 129.

Figure 5:
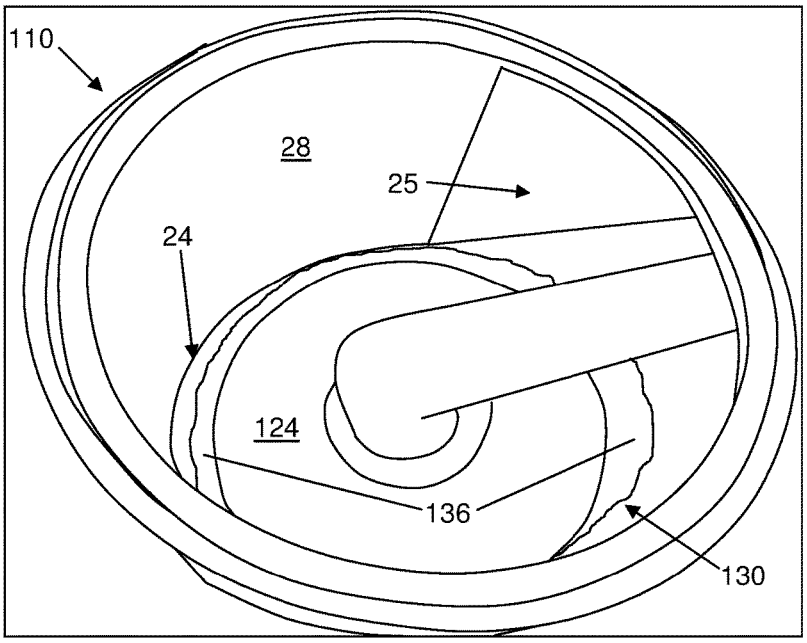
FIG. 5 is a view in perspective illustrating the skimmer, vacuum plate and gasket of FIG. 4.

The upper sidewall 28 and shoulder 24 of the skimmer 110 are shown in FIGS. 4 and 5 with the vacuum plate 124 disposed in an operable position above, and preferably adjacent, the shoulder 24. A gasket 130 is interposed between the vacuum plate 124 and the shoulder 24, just above the lower sidewall 22 and at the lower end of the upper sidewall 28. The gasket 130 is preferably a neoprene (polychloroprene or chloroprene rubber) sheet that is attached to one major surface of the rigid vacuum plate 124. The vacuum plate 124 may be made of polyvinyl chloride (PVC) plastic or any equivalently rigid material. The shoulder 24 may have a circular shape, and the vacuum plate 124 may also be circular. In such a situation, the gasket 130 is preferably also circular or substantially circular. The term "substantially circular" is defined herein as having outwardly-facing peripheral edges with an approximately circular shape. Even if the shape is slightly eccentric (oblong or oval), this is considered "substantially circular" as long as the wider diameter is not more than about 20 percent wider than the narrower diameter. In alternative embodiments, the gasket may have outer edges that are rectangular, triangular, or any other shape that will be understood by the person of ordinary skill as desirable to match the shape of the vacuum plate to which it is attached and the shape of the surface against which it will form a seal.

The gasket 130 may be a flexible planar neoprene sheet with peripheral edges that are in the shape of a substantial circle, with oppositely-facing first and second major surfaces. The vacuum plate 124 also has oppositely-facing first and second major surfaces, and may also be a planar sheet, but one that is rigid, meaning it will not readily deform more than the amount of its thickness under the forces encountered in normal use.

Figure 7:
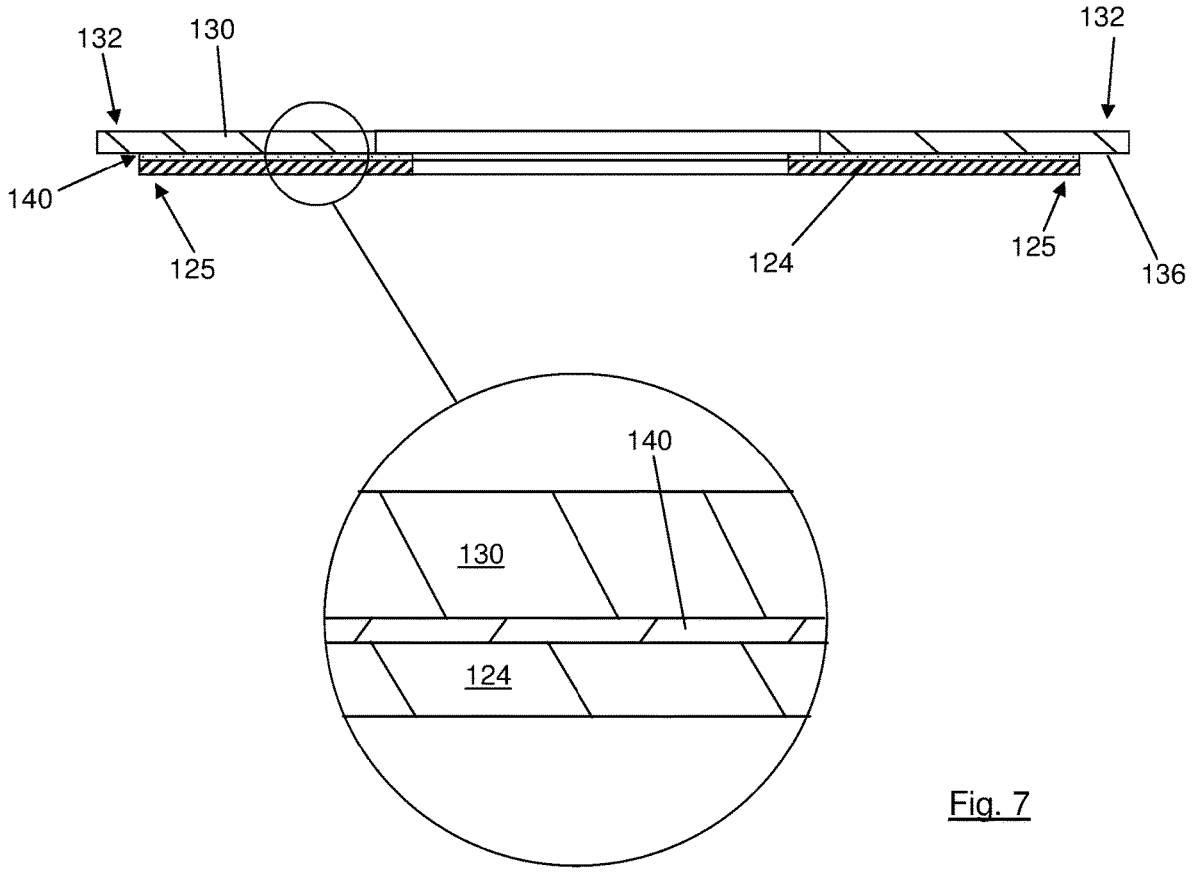
FIG. 7 is a side view illustrating a combination of a vacuum plate and a gasket, and a magnified view of the encircled portion.

An adhesive layer 140 is preferably disposed on one of the major surfaces of the gasket 130, and this adhesive layer 140 is placed in contact with one of the major surfaces of the vacuum plate 124. In practice, a manufacturer may cover the adhesive layer 140 with a removable layer, which may be disposable paper, so that the gasket may be transported and stored without adhering to anything, and then an end user may remove the paper to expose the adhesive 140. Of course, as an alternative the adhesive layer 140 may be placed on the vacuum plate 124 rather than the gasket 130, and the person having ordinary skill will understand how to adapt the assembly process to this modification. With the preferred embodiment, the adhesive side of the gasket 130 may be placed in contact with the vacuum plate 124 and pressure applied until the gasket 130 is strongly adhered to the vacuum plate 124 as shown in the configuration of FIG. 7. The combination of the vacuum plate 124 and gasket 130 may be constructed by an end user, or the combination may be manufactured and sold in the configuration shown in FIG. 7. Either way, this combination may be placed adjacent to the shoulder 24 with the gasket 130 facing downwardly as shown in FIG. 4.

Upon being disposed upon the shoulder 24, the combination of the gasket 130 and the vacuum plate 124 may seal the two facing surfaces so that little to no water can pass therethrough. Thus, the suction and movement of water in the downward direction toward the pipe 30 caused by the pump/filter 40 thereby causes the vacuum plate 124 to move downwardly and seat the gasket 130 against the shoulder 24, the sidewall 28 or both as shown in FIG. 4. This contact between the gasket 130 and the sidewall 28 and/or shoulder 24 forms a seal against a substantial amount of water passing by the vacuum plate 124 and gasket 130 combination. The gasket 130 may compress or flex to accommodate any slight variations in the corresponding shapes of the vacuum plate 124 and the sidewall 28 and/or shoulder 24. Furthermore, substantial suction will exert a substantial force against the gasket 130, thereby compressing the gasket 130 through its thickness. The neoprene material of which the gasket 130 is preferably made has pockets of gas trapped therein that permit compression of the gasket 130 to make it effectively thinner in localized regions to accommodate variations in shapes of the mating surfaces.

On the left side of FIG. 4, the gasket 130 is shown seated against the shoulder 24, and on the right side the gasket 130 is seated against the upper sidewall 28. The seal between the downwardly-facing surface of the gasket 130 and the shoulder 24 is considered a "primary seal," because the force urging the gasket 130 into the shoulder 24 is exerted primarily by the vacuum plate 124. The primary seal is the intended seal that causes the gasket to prevent flow of water past the vacuum plate 124 other than through the conduit 126. Any flow of water past the vacuum plate at the shoulder 24 or the sidewall 28 is undesirable, because it reduces the strength of the flow of water through the conduit 126, which is where the particles and other debris are drawn from the hose 128 and head 129 by the pump/filter 40.

The seal between the radially outwardly-facing surface of the gasket 130 and the upper sidewall 28 is also considered a primary seal, as long as the seal is within the plane of the vacuum plate 124. That is, if a seal is formed between the radially outwardly-facing surface of the gasket 130 and the upper sidewall 28, but this seal is above the top surface of the vacuum plate 124 (in the orientation of FIG. 4), this is not a primary seal, because the force urging the gasket 130 into the upper sidewall 28 is not exerted primarily by the vacuum plate 124. A seal caused by contact between the gasket 130 and the upper sidewall 28 above the top surface of the vacuum plate 124 is described below.

As shown in FIGS. 4, 5 and 7, the gasket 130 may extend farther outwardly than the peripheral edges 125 of the vacuum plate 124 so that a gasket lip 136 may be formed to provide a "secondary seal." The gasket 130 and the vacuum plate 124 are preferably aligned concentrically so that the peripheral edges 132 of the gasket 130 extend radially outwardly past the peripheral edges 125 of the vacuum plate 124 substantially the same distance on all sides to form the lip 136. Perfect concentric alignment is not critical, however, because the gasket 130 may have a wider gasket lip 136 on one side than another and still function well, as long as the radial dimension of the gasket lip 136 is sufficiently large on all sides to seal against the sidewall 28. With sufficient radial dimension, a circular gasket lip 136 is defined by the gasket's peripheral edges 132 that extend past the vacuum plate's peripheral edges 125. In a preferred embodiment, for a vacuum plate 124 of about six inches in diameter, the lip 136 extends at least about one-quarter of an inch past the vacuum plate peripheral edges 125, but more preferably about one-half of one inch to two inches. Most preferably the lip 136 extends about one inch to one and one-half inches past the vacuum plate peripheral edges 125 on all sides.

The circular gasket lip 136 is shown in FIGS. 4 and 5 extending along the sidewall 28 of the skimmer 110. The lip 136 thereby forms a flexible structure that can form a secondary seal against the sidewall 28 if there is sufficient leakage past the primary seal portion of the gasket 130, which is between the vacuum plate 124 and the shoulder 24 or between the vacuum plate 124 and the sidewall 28 within the plane of the vacuum plate 124. If there is a sufficient flow of water past the gasket lip 136, as shown in FIG. 4, due to an insufficient primary seal, the gasket lip 136 is urged outwardly by the flow of water to seat against the sidewall 28, thereby forming a secondary seal against the sidewall 28. This secondary seal inhibits or stops the flow of water past the vacuum plate 124 when the primary seal fails to do so sufficiently, and is caused by the flexibility of the gasket lip 136 where it is free to move above the plane of the vacuum plate 124. The gasket lip 136 formed by the portion of the gasket that extends past the peripheral edges 125 of the vacuum plate 124 defines flexible material that may expand outwardly when a sufficient outward force urges it. This outward force is small or nonexistent when the primary seal is sufficient, but increases the more insufficient the primary seal is due to the flow of water past the primary seal along the sidewall 28. As this flow increases, the outward force on the gasket lip 136 increases due to fluid dynamics known to persons having ordinary skill in the art. Therefore, the stronger the flow of water due to an insufficient primary seal, the stronger the force tending to form a secondary seal. With the primary seal, or if the secondary seal becomes necessary, the gasket 130 cooperates with the above-described structures to decrease leakage past the vacuum plate 124, thereby increasing suction through the head.

The neoprene used to form the gasket 130 is preferably at least one-sixteenth inches thick, and is preferably no greater than about three-sixteenths inches thick. The preferred thickness of the gasket material is about one-eighth inches thick. If the gasket 130 is too thick, it will not flex where it forms the gasket lip 136. If the gasket is too thin, it may be cut by the force applied by the peripheral edges 125 of the vacuum plate 124. Because foamed neoprene has gas pockets, this gives the gasket 130 a compressibility in the thickness direction that is desired for this application.

The central aperture 123 of the vacuum plate 124 is preferably aligned with the inner flow passage in the conduit 126. Thus, during operation of the pump/filter 40, the pool water pumped through the head 129, hose 128 and conduit 126 may flow through the aperture 123 past the vacuum plate 124. The gasket 130 preferably has a corresponding central aperture 134, which is preferably aligned with the vacuum plate's central aperture 123 to permit water to pass through the gasket 130. The gasket's central aperture 134 is at least as large as, and preferably substantially larger than, the vacuum plate's central aperture 123 and the diameter of the interior passage of the conduit 126 and/or hose 128. It is preferred that the aperture 123 be about two times the diameter of the interior passage of the conduit 126 and/or hose 128. Thus, for a gasket used with a six inch diameter vacuum plate with a one inch inner diameter conduit, the aperture 123 will be at least one inch in diameter, and may be 1.5 to 2.0 inches in diameter. Another aperture may be four inches in diameter. For a vacuum plate having an outer diameter of about six inches and a conduit of one inch inner diameter, a gasket may be seven inches in outer diameter with a central, centered hole about five inches in diameter. In another example, a vacuum plate that is 7.5 inches in outer diameter, the central aperture may be four inches in diameter.

The peripheral edges 132 of the gasket 130 preferably extend radially outwardly past the peripheral edges 125 of the vacuum plate 124 to form gasket lips 136 of about one inch for a vacuum plate that is about six inches in diameter. For smaller diameter vacuum plates, the gasket lips may be smaller and for larger diameter vacuum plates, the gasket lips may be larger. It is important that the gasket lips 136 extend radially outwardly of the peripheral edge of the vacuum plate 124 sufficiently to encourage a secondary seal that minimizes the amount of water that can pass between the vacuum plate 124 and the shoulder 24.

An adhesive layer 140 may be disposed on the entire major surface of the gasket 130 that faces the vacuum plate 124. However, this will cause the radially inwardly facing surfaces of the gasket lip 136 to have adhesive that may adhere to the top surface of the vacuum plate 124, or any adjacent surface. Therefore, it is also contemplated to apply an adhesive layer only to the portion of the gasket 130 that contacts the vacuum plate. Alternatively, the adhesive layer 140 may be applied to the vacuum plate 124 and then the gasket 130 may be placed over the vacuum plate 124. Still further, it is contemplated to remove any exposed adhesive on the gasket lip 136 after the gasket 130 and vacuum plate 124 are adhered together. It is also possible to use an adhesive that loses effectiveness or dissolves from to exposure to water or another chemical, such as chlorine. This would cause the adhesive to become much less tacky where exposed but would not affect the adhesion of the adhesive that is interposed between the gasket and the vacuum plate.

In order to construct a combination of the gasket 130, the skimmer 110 and the vacuum plate 124, the gasket 130 is adhered to the vacuum plate 124 as described above and as shown in FIG. 7. The combination vacuum plate 124 and gasket 130 is placed on the shoulder 24 with the gasket facing the shoulder 24, which is in a downward direction as shown in the orientation of FIG. 4. One end of the hose 128 is attached to the distal end 126' of the conduit 126, and the other end of the hose 128 is attached to the vacuum head 129. When the pump/filter 40 is in operation, it causes the vacuum plate 124 and gasket 130 combination to be drawn downwardly toward the shoulder 24 by suction from the pipe 30 that does not leak around the vacuum plate 124/shoulder 24 junction. Thus, the construction process may begin by turning off the pump, but the pump may also be left on. The gasket 130 forms a primary seal against the shoulder 24 and/or the sidewall 28 to reduce the amount of water that flows past the vacuum plate 124 other than that water passing through the conduit 126. In at least one case the vacuum upstream of the pump/filter 40 caused by the gasket's 130 primary and secondary seals changed from about 2.0 inches Hg with only the vacuum plate, to about 14 inches Hg when using the gasket 130 and vacuum plate 124. This substantial increase in vacuum was repeated under the same circumstances with the same result.

A substantial force is required to remove the vacuum plate 124 and gasket 130 combination from contact with the shoulder 24 when the pump is operating. Thus, the combination is not generally removed from the shoulder 24 during operation of the pump, even deliberately by hand. In order to remove the combination, the pump/filter 40 should be turned off. Once the vacuuming is completed, the user turns off the pump/filter 40 and removes the vacuum plate 124 and gasket 130 combination, along with the hose 128 and head 129. The skimmer 110 can then be used in a conventional, passive fashion once the pump is turned back on.

An advantage that neoprene has over other gasket materials is that it is compressible in the direction of its thickness at the pressures and the thicknesses contemplated herein. It's the thickness-direction compressibility that creates the primary seal that is so important to preventing leakage. If the neoprene is too thick it can be cut by the edges of the vacuum plate 124. For the thicknesses of neoprene contemplated, it is preferred that the gasket lip 136 be in a range of one-half inches to two inches extending radially outwardly from the vacuum plate peripheral edges 125. A more preferred range is one inch to one and one-half inches.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A pool vacuum comprising:

(a) a skimmer mounted to a wall of a pool and having a chamber that is in fluid communication with water in the pool through an aperture formed in the pool wall that is aligned with an aperture in the skimmer sidewall, the skimmer having a shoulder disposed between a skimmer floor and the skimmer sidewall aperture;

(b) a rigid vacuum plate disposed in the chamber and having a conduit extending therefrom into the pool water and terminating in a vacuum head, the vacuum plate having a lower surface facing, and disposed adjacent, the shoulder;

(c) a neoprene gasket attached to the vacuum plate and interposed between the vacuum plate and the shoulder, wherein the gasket has a central hole aligned with the conduit to permit a flow of water through the conduit to pass through the gasket and wherein the gasket has peripheral edges that extend beyond peripheral edges of the vacuum plate and are interposed between the vacuum plate and the skimmer sidewall, and extend above the shoulder; and (d) a pump fluidly connected to the chamber of the skimmer for pumping water through the vacuum head, the conduit, the gasket, and the vacuum plate, wherein the gasket peripheral edges extend from the shoulder upwardly along the skimmer sidewall to form a secondary seal.

2. The pool vacuum in accordance with claim 1, wherein the gasket is adhered to the vacuum plate.

3. The pool vacuum in accordance with claim 1, wherein the hose passes through the skimmer sidewall aperture and the pool wall aperture.

4. A method of constructing a pool vacuum, the method comprising:

(a) providing a skimmer on a wall of a pool, the skimmer having:

(i) a chamber in fluid communication with pool water through an aperture formed in the pool wall that is aligned with an aperture in the skimmer sidewall; and (ii) a shoulder disposed between a skimmer floor and the skimmer aperture;

(b) disposing a rigid vacuum plate in the chamber with vacuum plate peripheral edges adjacent the skimmer shoulder, the vacuum plate having a conduit extending into the pool water and terminating in a vacuum head;

(c) attaching a neoprene gasket to the vacuum plate, the gasket interposed between the vacuum plate and the shoulder, the gasket having peripheral edges extending radially outwardly of the vacuum plate peripheral edges to at least between the vacuum plate peripheral edges and the skimmer sidewall;

(d) pumping pool water through the vacuum head, the conduit, the vacuum plate, a central hole in the gasket aligned with the conduit, and the chamber, whereby the gasket seats against at least one of the shoulder and the skimmer sidewall; and (e) extending the gasket peripheral edges above the top edge of the vacuum plate to form secondary seals in case of a sufficient flow of water past the shoulder.

5. The method in accordance with claim 4, wherein the attaching step further comprises adhering the gasket to the vacuum plate with the central hole in the gasket aligning with the conduit.

6. A pool vacuum component comprising:

(a) a rigid vacuum plate having a centrally located aperture and peripheral edges, the vacuum plate having oppositely-facing first and second substantially planar vacuum plate surfaces;

(b) a gasket made of neoprene having a centrally located aperture and peripheral edges, the gasket having oppositely-facing first and second substantially planar gasket surfaces; and (c) an adhesive interposed between the first gasket surface and the first vacuum plate surface, thereby fixing the gasket to the vacuum plate, wherein the gasket peripheral edges extend outwardly of the disk peripheral edges.

7. The pool vacuum component in accordance with claim 6, wherein the vacuum plate peripheral edges are substantially circular, the gasket peripheral edges are substantially circular and the gasket is substantially annular.

* * * * *